US005213855A

United States Patent [19]

Buxton

[11] Patent Number: 5,213,855

[45] Date of Patent: May 25, 1993

[54] ARTIFICIAL SAGUARD CACTUS

[76] Inventor: William C. Buxton, 4900 Reynolds, Fort Worth, Tex. 76180

[21] Appl. No.: 785,513

[22] Filed: Oct. 31, 1991

[51] Int. Cl.[5] ..... A41G 1/00

[52] U.S. Cl. ..... 428/17; 156/61; 428/22

[58] Field of Search ..... 156/61; 47/55, 71; D11/117; 428/17, 18, 22; D21/150

[56] References Cited

U.S. PATENT DOCUMENTS

| | | | |
|---|---|---|---|
| D. 310,696 | 9/1990 | Satoh et al. | D21/150 |
| D. 311,559 | 10/1990 | Satoh et al. | D11/117 X |
| 1,386,450 | 8/1921 | Tully | 428/17 |
| 2,080,523 | 5/1937 | Williams et al. | 428/18 |
| 2,166,002 | 7/1939 | Fritsch | 428/18 |

FOREIGN PATENT DOCUMENTS

| | | | |
|---|---|---|---|
| 563693 | 6/1957 | Italy | 428/18 |

*Primary Examiner*—Henry F. Epstein
*Attorney, Agent, or Firm*—Crutsinger & Booth

[57] ABSTRACT

An artificial cactus of landscape timbers simulating natural saguare cactus comprising a generally vertical trunk and a plurality of multi-section arms affixed to said trunk at generally irregular spacing, the first section joined to the trunk at an angle with said trunk of between about 90 and about 60 degrees and each successive section joined to adjacent sections at an angle of between about 15 and about 30 degrees, the last of said sections being oriented in an approximately vertical direction. Each arm has a metallic rod member extending longitudinally through the sections and transversely through the trunk and a plurality of fastener means engaging the rod at intervals with each said fastener bearing against one of the trunk or sections to fix the sections together and to the trunk; and a plurality of natural fiber rope lengths stapled longitudinally along said trunk and each of the arms.

18 Claims, 3 Drawing Sheets

ARTIFICIAL SAGUARD CACTUS

FIELD OF INVENTION

This invention relates to artificial plants and more particularly to an artificial saguaro giant cactus.

BACKGROUND

Artificial plant are commonly made from all-plastic materials or from dead natural trunks or main stems and major branches to which are affixed artificial greenery such as small stems and leaves. Such dead natural trunks, main stems and major branches are customarily from the type of plant to be imitated.

Most artificial plants are ordinarily designed for indoor use and are of appropriate size for such use. Additionally, such indoor use artificial plants do not require the structural strength to withstand the extremes of nature such as summer heat and bright sun, winter cold and icing conditions, high winds and severe storms.

The giant saguaro simulated by the structure of the present invention is a large, often very large, outdoor plant growing up to 50 feet in height. Thus, the present artificial saguaro cactus is meant to be primarily an outdoor display and is designed to be structurally sound in an outdoor environment. Further, it is designed to withstand children or even adults playing or climbing upon it. In addition, it is designed to give the prickly, stickery, spiny appearance of the natural cactus but to be, in fact, not dangerous and not uncomfortable or painful for persons to come in contact with.

SUMMARY OF THE INVENTION

The artificial saguaro cactus of the present invention comprises a main body and stems of straight sections of somewhat rounded wood timbers or boles finished or dressed to the degree that persons handling, gripping or touching them would be unlikely to be injured by splinters and the like. The main body and stem sections are held together by fully-threaded metal rods extending lengthwise through the timber sections. The sections are pulled together by thread nuts on the rods tightened against counter-sunk areas in the individual sections. "Grassy" rope of natural fiber is attached in lengthwise rows along the body and stems to simulate the raised "spiny" rows of the natural cactus. The whole structure is then sprayed lightly with green paint to a dull surface. If desired, artificial flower "clumps" may be added to the ends of the trunk and stems.

Thus, it is an object of the present invention to provide an artificial cactus simulating a natural saguaro cactus.

It is a further object to provide an artificial cactus suitable for extended exposure in the outdoors to relatively severe environment extremes.

It is an even further object to provide an artificial cactus simulating a saguaro cactus having the appearance of bearing the sharp needles and spines of a natural saguaro cactus while being relatively safe and harmless to touch.

It is an even further object of the invention to provide an artificial saguaro cactus of sufficient structural strength to withstand normal human contact and mild abuse.

BRIEF DESCRIPTION OF THE DRAWINGS

These and other objects and advantages of the present invention will become apparent from the following detailed description when read with reference to the accompanying drawings in which.

DETAILED DESCRIPTION OF A PREFERRED EMBODIMENT

Figure 1:
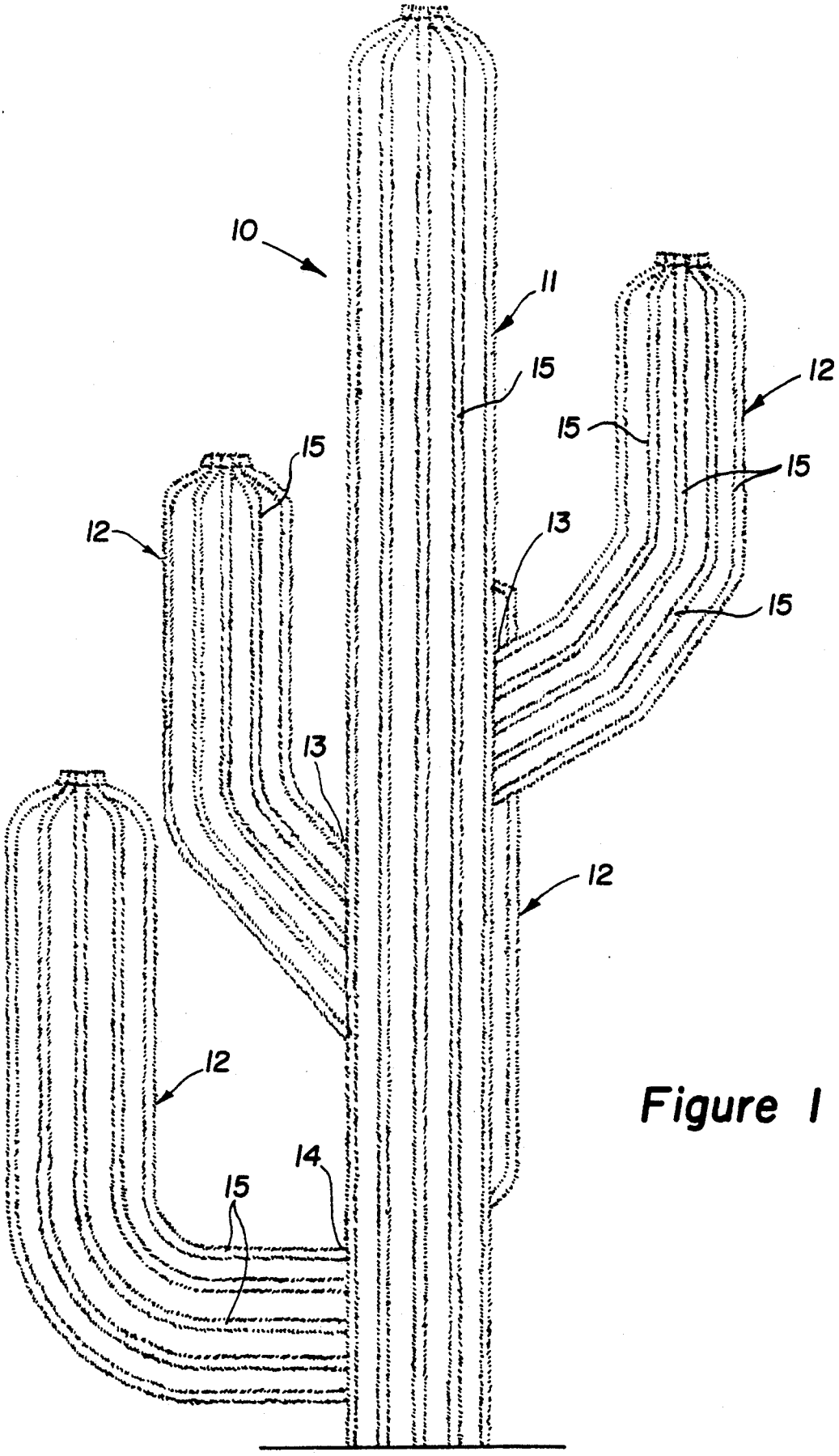
FIG. 1 is an elevational view of an artificial saguaro cactus according to the present invention.

Turning now to FIG. 1, there is shown a front elevation view of the artificial saguaro cactus 10 of the present invention. The artificial cactus 10 comprises an upright trunk or main body 11 having a plurality of stems or arms 12 extending from arbitrary points along the trunk in various directions. The stems 12 may appear to emerge from the trunk 11 at slight angles as indicated at 13 or essentially horizontally as shown at 14 before following a curve to the upright extension as shown. Inasmuch as the number, shape, direction and location of arms on a natural cactus varies considerably from plant to plant, the artificial cacti of the present invention are constructed with similar wide variation as to the stems.

As will be discussed subsequently in greater detail, the main body 11 and arms 12 of the artificial plant are constructed of generally rounded elongated bodies of suitably strong and tough material. A preferred material is wood, more specifically preservative pressure impregnated or treated pine lumber of the type exemplified by a widely available so-called "landscape timbers." Such timbers come in standard eight foot lengths of generally rounded cross sections approximately 6 inches in diameter and slightly "flatted" on two opposing sides. Of course, essentially any reasonably straight bole of an appropriate size, pressure treated or not, may be used.

It will be noted that the artificial cactus of the present invention has ridge rows 15 that simulate the raised rows or ridges of sharp needles or spines present on natural cactus of this type. These ridge rows 15 are present in both the main body 11 and the arms 12 of the structure just as in the natural cactus.

The ridge rows 15 are comprised of lengths of rather rough natural fiber rope often referred to as "grass rope." A characteristic of such rope is the many wild or loose-end fibers sticking out from the body of the rope. While such fiber strands are flexible and not sharply pointed, they provide the appearance of "stickery" needles or sharp-pointed spines of the real cactus. This is especially true when the rope has been lightly sprayed with paint or lacquer giving the fibers an even thicker, stiffer and more dangerous look. Still, the rope fibers remain extremely safe to touch and brush against. When an even rougher or spinier look is desired, the surface of the rope may be scraped or abraded to provide even more "wild" fibers.

In assembling the artificial cactus of the present invention, the timbers of the type previously described of appropriate size and length are selected for the main body or trunk 11. If pressure-treated boles are to be used, they are usually obtainable in any selected length. If, however, the cactus is to be built of ordinary landscape timbers because they are so readily available from almost any local building materials or landscape company or garden center, it may be necessary to fasten two such timbers together if the cactus is to be of greater height than eight feet, the standard length for landscape timbers. If timbers are to be fastened together for the trunk, it may be done in the manner to be described subsequently or by any other suitable means.

Figure 2:
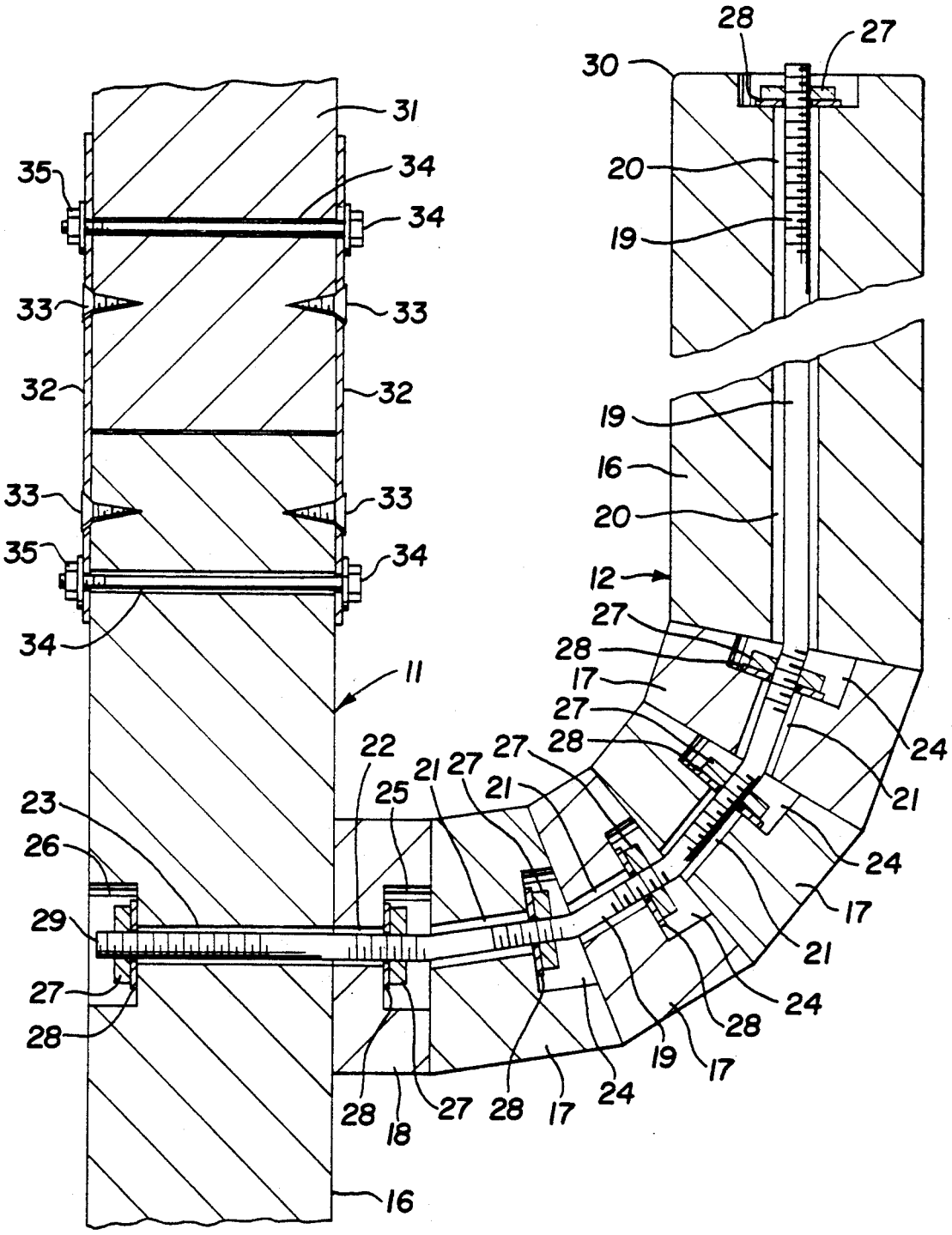
FIG. 2 is a cross-section view of a portion of an artificial cactus of the present invention illustrating the structure of the trunk and an arm.

The method of constructing the artificial cactus of the present invention is shown by FIG. 2, which is a cross-sectional view of a portion of an artificial cactus in the area where a stem or arm 12 is joined to the trunk 11. The main upright 16 of the stem 12 may be made of the same material as the trunk; i.e., a pressure-treated bole or landscape timber. The curve portion of the stem 12 is made from between about three and about six wedge-cut pieces from the same or similar bole or timber as the main upright; in FIG. 2, four of the stem-wedge pieces 17 are shown along with a horizontal section 18 of the same pressure-treated material. The stem main upright 16, the wedge pieces 17 and the stem horizontal piece 18 are held together and to the trunk by a fully-threaded metal rod 19 that passes through longitudinal passageways or bore holes 20, 21 and 22 and the stem upright 16, wedge pieces 17 and horizontal section 18, respectively, and then through a transverse passageway or bore hole 23 in the trunk 11. The passageways 21 and 22 are each counter sunk as shown at 24 and 25, respectively. Transverse bore hole 23 is counter sunk as indicated at 26 in the opposite side of the trunk 11 from the stem 12. Thread nuts 27 engage the threads of rod 19 to hold the stem upright 16, wedge pieces 17 and horizontal piece 18 together and hold the stem assembly 12 to the trunk 11. Washers 28 may be used under the nuts 27.

In assembling the artificial cactus of the present invention, a first stem piece, such as horizontal section 18 of desired length, is attached to the trunk by means of a rod 19 of a length determined by the size of stem desired. The rod 19 may be an "all-thread" rod, or it may have threads at appropriate positions along its length. At the beginning of the process, the rod 19 may be straight. The rod is positioned in the trunk 11 such that nut 27 and rod end 30 do not extend out of the counter sink 26. The other nut 27 is positioned so as not to protrude from counter sink 25. Nuts 27 are tightened so that horizontal section 18 is held firmly against the trunk 11.

When landscape timbers are used as the construction material of the cactus, the first stem section 18 may be affixed to one of the "flats" of the trunk, thus lessening any tendency for the stem to wobble. When the construction material is without flats or the stem is to be attached to the rounded side of a landscape timber, the abutting surface of the horizontal section can be "hollowed" to a concave shape for a tighter fit against the trunk 11 so that the tendency to wobble is lessened. Since the stems of natural saguaro cacti are of such variety of shape, the first stem section attached to the trunk of the artificial unit may, if desired, be one of the wedge sections 17 without degrading the natural look of the unit.

Subsequent to the tightening of the first stem section 18 to the trunk, a second stem section, such as a wedge piece 17, is slipped over the rod 19 to abut the first section 18 with its narrower side up. A washer 28 and thread nut 27 are placed on the rod 19 turned on the rod until the wedge piece 17 is held snug against the first end piece 18 already attached to the trunk 11. The third, fourth and subsequent stem pieces are added to the rod 19, and each, in turn, is snugged against the previously installed wedge piece by tightened washer 28-nut 27 combination as shown.

As each wedge piece 17 is added, the thread nut 27 holding it is tightened so that the cross surfaces of the wedge pieces 17 abutting are in full contact substantially totally across the faces of the joint pieces 17. As illustrated, the rod 19 is bent slightly in the vicinity of each joint in the stem by the pressure from the nut 27 so that eventually it is brought into position so that it holds a stem upright 16 in a vertical position when washer 28 thread nut 27 at the upper end 30 of section 16 are tightened.

Additional arms are added to the trunk as desired in the manner just described.

Should it be found desirable to lengthen the trunk 11 to make the artificial cactus taller, an additional section 31 of timber can be placed end to end at the top of trunk member 11 and affixed thereto with a metal joiner plate 32 spanning the joint between the members 11 and 31 and secured to each by either wood screws 33 or threaded bolts 34 extending through bore holes 36 and engaged by thread nuts 35 as shown. Joiner plates 32 may be vertically extending strips or plates from one to several inches wide or may be a single curved plate or tube encircling the two timbers.

After assembly of as many arms 12 as desired to the main trunk 11, the simulated spine ridges 15 can be added. The ridges 15 may comprise lengths of so-called "grass" rope, a natural-fiber rope of the hard fiber type characterized by numerous stray loose-end fibers such as sisalana fiber or sisal rope from Brazil.

Figure 3:
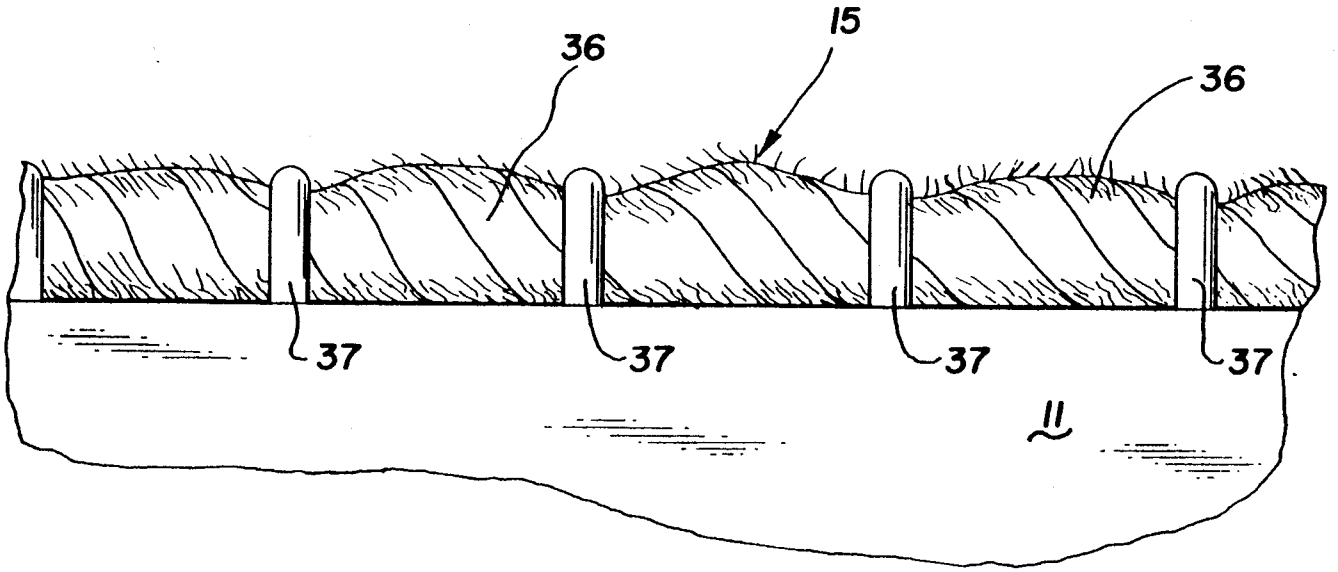
FIG. 3 is a partial side view of an arm of an artificial cactus illustrating the manner of attachment of the "grass" rope.

Lengths of the "grass" rope are attached in lengthwise rows along the trunk and stems of the artificial cactus as shown in FIG. 1. Attachment may be by glue or nails but preferably is by metal staples looping over the rope as illustrated in FIG. 3 so as to simulate the "tufted" appearance of spine clumps on the natural cactus. In FIG. 3, the "grass" rope 36 of simulated spine ridge 15 is attached to the main body 11 by means of ordinary "U" shaped metal staples 37. Staples 37 are driven hard into the wood of trunk 11 or stems 12 so as to "pinch" the rope 36. For best simulations, staples should be used every 2 or 3 inches. As many rope spine rows or ridges 15 as thought appropriate may be applied, but it has been found that use of between 8 and 20 rows, per arm or trunk, depending on the size of the trunk and limbs, provides the best simulation.

Subsequent to the application of the spine ridge ropes, the whole structure may be sprayed lightly with paint of an appropriate green color. The paint should not be applied as a full covering coat, but only lightly to produce a dull or matte-like finish of greenish cast.

Once the structure of the artificial saguaro cactus is completed, it may be placed upright with its lower end buried between 2 to 4 feet in the ground. For more permanent display, it may be set in the ground in concrete.

It is to be realized that many changes and modifications may be made in the artificial cactus above described without departing from the spirit of the invention; therefore, it is intended that this invention be limited only as set forth in the following claims.

What is claimed:

1. An artificial cactus simulating natural saguaro cactus comprising: a generally vertical rounded timber trunk; a plurality of multi-section rounded timber arms affixed to said trunk at generally irregular spacing, the first section of each of said plurality of arms being joined to said trunk at an angle with said trunk of between about 90 and about 60 degrees; each successive section of each said arm being joined to adjacent sections at an angle of between about 15 and about 30 degrees with the last of said sections oriented in an approximately vertical direction; each said arm having a metallic rod member extending longitudinally through said sections of the arm and transversely through said trunk; a plurality of fastener means engaging said rod at intervals with each said fastener bearing against one of said trunk or said sections to affix said sections together and to said trunk; and a plurality of natural fiber rope lengths affixed longitudinally along said trunk and each of said plurality of arms in simulation of spine ridges.

2. The artificial cactus of claim 1 wherein said rounded timbers comprise pressure preservative-impregnated boles.

3. The artificial cactus of claim 2 wherein said boles are landscape timbers having two opposing flat sides.

4. The artificial cactus of claim 1 wherein said rod members comprise fully-threaded steel rods, and said fasteners comprise thread nuts.

5. The artificial cactus of claim 2 wherein said rod members comprise fully-threaded steel rods, and said fasteners comprise thread nuts.

6. The artificial cactus of claim 1 further comprising a plurality of natural fiber rope lengths affixed longitudinally over essentially the full length of said trunk and said plurality of arms.

7. The artificial cactus of claim 4 further comprising a plurality of natural fiber rope lengths affixed longitudinally over essentially the full length of said trunk and said plurality of arms.

8. The artificial cactus of claim 5 further comprising a plurality of natural fiber rope lengths affixed longitudinally over essentially the full length of said trunk and said plurality of arms.

9. The artificial cactus of claim 1 further comprising a dull surface light coating of spray paint as coloring.

10. The artificial cactus of claim 6 further comprising a dull surface light coating of spray paint as coloring.

11. The artificial cactus of claim 7 further comprising a dull surface light coating of spray paint as coloring.

12. The artificial cactus of claim 6 wherein the surfaces of said rope lengths have been roughened to produce additional loose-end fibers.

13. The artificial cactus of claim 7 wherein the surfaces of said rope lengths have been roughened to produce additional loose-end fibers.

14. The artificial cactus of claim 8 wherein the surfaces of said rope lengths have been roughened to produce additional loose-end fibers.

15. An artificial cactus simulating natural saguaro cactus comprising: a generally vertical rounded wooden trunk of preservative pressure-treated landscape timber; a plurality of wooden arms attached to said trunk at generally irregular spacing and extending from said trunk in various horizontal orientations and at various angles with said trunk of between about 60 degrees and about 90 degrees, said arms comprising multiple sections of preservative pressure-treated landscape timber each of said multiple sections of a limb being joined to adjacent sections at an angle therewith at an angle of between about 15 degrees and about 30 degrees with the end-most section being oriented in an essentially vertical direction; each said arm having a threaded steel rod member extending longitudinally through said multiple sections and transversely through said trunk; a plurality of thread nut fastener members engaging said rod at intervals along the length of said rod, each said fastener bearing against one of said trunk or said sections to affix said sections together and to said trunk; and a plurality of natural fiber grass rope lengths each stapled at short intervals longitudinally along essentially the entire length of each of said plurality of arms and said trunk in simulations of spine ridges of a natural cactus.

16. The artificial cactus of claim 15 further comprising a dull surface light coating of spray paint.

17. The artificial cactus of claim 16 wherein the surfaces of said "grass" ropes have been roughened to produce additional loose-end fibers.

18. An artificial cactus simulating natural saguaro cactus comprising: a generally vertical rounded wooden trunk of preservative pressure-treated landscape timber; a plurality of wooden arms attached to said trunk at generally irregular spacing and extending from said trunk in various horizontal orientations and at various angles with said trunk of between about 60 degrees and about 90 degrees, said arms comprising multiple sections of preservative pressure-treated landscape timber each of said multiple sections of a limb being joined to adjacent sections at an angle therewith at an angle of between about 15 degrees and about 30 degrees with the end-most section being oriented in an essentially vertical direction; each said arm having a threaded steel rod member extending longitudinally through said multiple sections and transversely through said trunk; a plurality of thread nut fastener members engaging said rod at intervals along the length of said rod, each said fastener bearing against one of said trunk or said sections to affix said sections together and to said trunk; and a plurality of natural fiber grass rope lengths having loose-end fibers extending from roughened surfaces and each stapled at short intervals longitudinally along essentially the entire length of each of said plurality of arms and said trunk in simulations of spine ridges of a natural cactus; and a dull surface light coating of spray paint.

* * * * *

UNITED STATES PATENT AND TRADEMARK OFFICE

CERTIFICATE OF CORRECTION

PATENT NO. : 5,213,855

DATED : May 25, 1993

INVENTOR(S) : William C. Buxton

It is certified that error appears in the above-identified patent and that said Letters Patent is hereby corrected as shown below:

On the title page, Item [54]
In the title, change "SAGUARD" to -- SAGUARO --

In the Abstract, line 2, change "saguare" to -- saguaro --

Col. 1, line 2, change "SAGUARD" to -- SAGUARO --

Col. 1, line 9, change "plant" to -- plants --

Signed and Sealed this

Twenty-fifth Day of January, 1994

*Attest:*

Bruce Lehman

BRUCE LEHMAN

*Attesting Officer*

*Commissioner of Patents and Trademarks*